US008984830B2

(12) United States Patent
Wieleba

(10) Patent No.: US 8,984,830 B2
(45) Date of Patent: Mar. 24, 2015

(54) HEAT INSULATION ELEMENT AND A COMPOSITE FOR INSULATING A BUILDING FAçADE

(75) Inventor: Rolf Wieleba, Horgertshausen (DE)

(73) Assignees: Rockwool International A/S, Hedehusene (DK); Deutsche Rockwool Mineralwoll GmbH & Co. OHG, Gladbeck (DE)

( * ) Notice: Subject to any disclaimer, the term of this patent is extended or adjusted under 35 U.S.C. 154(b) by 0 days.

(21) Appl. No.: 13/819,294

(22) PCT Filed: Aug. 18, 2011

(86) PCT No.: PCT/EP2011/004158
§ 371 (c)(1),
(2), (4) Date: Apr. 16, 2013

(87) PCT Pub. No.: WO2012/031674
PCT Pub. Date: Mar. 15, 2012

(65) Prior Publication Data

US 2013/0205701 A1 Aug. 15, 2013

(30) Foreign Application Priority Data

Sep. 9, 2010 (EP) ..... 10009410

(51) Int. Cl.
*E04B 1/80* (2006.01)

(52) U.S. Cl.
USPC ..... 52/404.2; 428/78; 428/47; 52/385; 52/390; 52/389; 52/745.19

(58) Field of Classification Search
USPC ..... 52/404.1–404.4, 406.2, 384–391, 52/589.1, 592.1, 591.1, 745.19, 796.1, 52/747.11, 747.12, 747.13; 428/78, 47
See application file for complete search history.

(56) References Cited

U.S. PATENT DOCUMENTS

| | | | | |
|---|---|---|---|---|
| 2,435,738 | A * | 2/1948 | Crafton | 29/253 |
| 4,646,498 | A * | 3/1987 | Schneller et al. | 52/309.12 |
| 7,121,051 | B2 * | 10/2006 | Hunsaker | 52/314 |
| 2011/0154764 | A1 * | 6/2011 | Wang et al. | 52/309.1 |

FOREIGN PATENT DOCUMENTS

| | | | |
|---|---|---|---|
| DE | 19524703 | A1 | 1/1997 |
| EP | 1203847 | A1 | 5/2002 |
| FR | 2588587 | A1 | 4/1987 |
| GB | 2345924 | A * | 7/2000 |

* cited by examiner

*Primary Examiner* — Jeanette E. Chapman
(74) *Attorney, Agent, or Firm* — John Wilson Jones; Jones & Smith, LLP

(57) ABSTRACT

The invention relates to a heat insulation element for insulating building facades, in particular for heat insulation composite systems, composed of a heat insulating board and a reinforcement mesh that can be penetrated by fastening elements, in particular plugs, wherein the reinforcement mesh is placed in the area of a large surface of the heat insulating board. It is the object of the invention to avoid the disadvantages of the state of the art and in particular to provide a heat insulation element which even in case of high tightening torques of the fastening elements does not excessively tends to be deformed into the direction of the building facade. This aim is achieved by a heat insulation element according to the invention, in which the reinforcement mesh is arranged as a component of an abutment at a distance to the surface of the heat insulating board and in which the reinforcement mesh comprises a surface area which is smaller than the area of the surface of the heat insulating board.

19 Claims, 4 Drawing Sheets

HEAT INSULATION ELEMENT AND A COMPOSITE FOR INSULATING A BUILDING FAçADE

The invention relates to a heat insulation element for insulating building facades, in particular for heat insulation composite systems, composed of a heat insulating board and a reinforcement mesh that can be penetrated by fastening elements, in particular plugs, wherein the reinforcement mesh is placed in the area of a large surface of the heat insulating board. The invention furthermore relates to a heat insulation composite system for the insulation of a building facade, composed of board shaped insulation elements, a rendering system and fastening elements which connect the insulation elements to the building facade. Said systems also known as External Thermal Insulation Composite Systems (ETICS). Finally, the invention relates to a method for producing such a heat insulation composite system.

From DE 195 24 703 A1 for example a heat insulation surface element having an external surface serving as plaster base is known. This heat insulation surface element can be fixed to a wall by means of holding heads of wall anchorage elements, which heads are adjacent to the external surface, wherein the external surface comprises a reinforcing strip that is sufficiently resistant for receiving the traction forces of the holding heads. The reinforcing strip is placed immediately on the external surface and essentially consists of glass fiber. From this publication a composite system comprising corresponding heat insulation surface elements is furthermore known, wherein the heat insulation surface elements are fixed to a wall by means of fastening elements adjacent through holding heads to an external surface of the heat insulation surface element and are covered by a plaster layer applied to the external surface.

Furthermore, DE 34 09 592 A1 discloses a heat insulation composite system which consists of several heat insulation elements, preferably laid as a compound structure and respectively composed of a heat relief body and a coating carrier layer which comprises a reinforcing layer. The reinforcing layer projects with an overlapping strip at least over a border of the heat relief body. Furthermore, a border zone is provided in these heat insulation elements, which border zone does not comprise any reinforcing layer and serves for receiving an overlapping strip of an adjacent heat insulation element, such that adjoining heat insulation elements are connected to each other by means of the reinforcing layer.

Finally, DE 44 16 536 A1 discloses a heat insulation element in the form of a façade heat insulating board made of mineral wool which is in particular suitable for heat insulation composite systems composed of heat insulating boards and multi-layer rendering systems applied thereon. The façade heat insulating board can be fixed to the underground, i.e. the façade, by means of plugs or like fastening elements. In order to prevent the plugs from sliding out, a wide-meshed formation that covers over the main surface of the heat insulating board is provided, which is laminated on the heat insulating board in the factory such that the formation is placed immediately on the main surface of the heat Insulating board.

Principally, the state of the art provides such heat insulation elements, the complete surface of which is coated with a reinforcement mesh, wherein the reinforcement mesh is arranged immediately on the large surface of the heat insulation element and penetrated by fastening elements. These embodiments according to the state of the art have the disadvantage that with a too strong tightening torque of the fastening elements both the heat insulation element and the reinforcement mesh are drawn-in into the direction of the building facade such that corresponding recesses have to be afterwards filled with larger quantities of plaster during the plaster application. This procedure leads on the one hand to the fact that a higher quantity of cost intensive plaster material has to be used and that on the other hand the carrying capacity of a heat insulation composite system configured in such a way reaches the load limit due to the thicker plaster layer. If over and above that higher wind suction loads occur, a sufficient stability can be possibly not assured. Finally the all-over reinforcement mesh has the disadvantage that there is an all-over high layer thickness.

It is now the object of the invention to avoid the above mentioned disadvantages of the state of the art and in particular to provide a heat insulation element which even in case of high tightening torques of the fastening elements does not excessively tends to be deformed into the direction of the building facade. Furthermore, a stable heat insulation composite system avoiding the above mentioned disadvantages shall be created.

This aim is achieved by a heat insulation element according to the invention, in which the reinforcement mesh is arranged as a component of an abutment at a distance to the surface of the heat insulating board and in which the reinforcement mesh comprises a surface area which is smaller than the area of the surface of the heat insulating board.

A heat insulation element configured like this has the advantage that on the one hand most of the surface of the heat insulating board is free of reinforcement meshs such that the rendering system can be directly applied onto the major part of the surface of the heat insulating board. On the other hand, the heat insulation element according to the invention has the advantage that thanks to the abutment and the distance between the reinforcement mesh and the surface of the heat insulating board, a high tightening torque of the fastening element does not cause the reinforcement mesh and the insulating board to be deformed into the direction of the building façade. On the contrary, the abutment receives the corresponding tightening torques and the reinforcement mesh finally serves to distribute the loads, even on condition that the reinforcement mesh is deformed by the tightening torque into the direction of the abutment. The embodiment according to the invention of a heat insulation element in particular also leads to the fact that the plug pull-through resistance of the heat insulation composite system and/or the heat insulation element is considerably increased.

The above mentioned advantages in particular result for an embodiment of the heat insulation element comprising a heat insulating board made of mineral fibers, in particular rock wool fibers, bound by means of binders.

According to another characteristic of the invention it is provided that the reinforcement mesh is connected to a carrier, in particular made of an adhesive mortar, keeping a distance to the surface of the heat insulating board, wherein the carrier and the reinforcement mesh are components of the abutment. In this embodiment, the abutment is formed by a carrier and the reinforcement mesh, wherein the carrier provides the distance between the surface of the heat insulating board and the reinforcement mesh. Usually the distance in this area is only some few, for example 2 to 5 mm which are sufficient for providing the above explained effect of the heat insulation element according to the invention.

The carrier is in particular made of adhesive mortar. But also other hydraulic, or non-hydraulic (e.g. cement-free) setting agents having a high gluing effect can be used herein.

According to another characteristic of the invention it is provided that the heat insulating board comprises at least one abutment, in particular two abutments. These abutments can be for example arranged opposite each other such that they are placed centrically with respect to the longitudinal axis of the heat insulating board and respectively comprise coincident distances to adjacent small and/or long side walls. This offers the possibility to install the heat insulating board independent from the direction and simultaneously to achieve a sufficient fixation of the heat insulating board in the heat insulation composite system. Other fastening elements, such as additional plugs are no more required then. Preferably it is provided that one abutment is provided per one square meter of the heat insulating board. But it is also possible to determine the number of the abutments in dependence on the building surface to be heat insulated. Herein, it has also to be considered that, of course, not every abutment has to be used for fastening the heat insulating board. Besides, the number of the required fastening elements depends on the arrangement of the heat insulation elements on the building. Herein, wind suction loads and also the weight of the entire heat insulation composite system have to be taken into consideration. The heat insulation element according to the invention allows to use only one fastening element per square meter without consideration of an adhesive mortar which connects the insulation element to the façade. Because of this there is no need of an adhesive mortar to fix the insulation element according to the invention because of stability under load reasons. The thermal insulation can therefore be fixed to the façade with mechanical fasteners only. Even with higher forces resulting from wind occurring in larger heights and in the areas of corners of the facade or the building an increase of the number of mechanical fasteners is not necessary with the insulation elements according to the invention if an adhesive mortar and/or the strength, especially the pull-off strength is incorporated into the calculation of the stability under load as transferring the load, which is not admissible nowadays. These advantages can be easily used in connecting with facades having heights of more than 12 meters.

With the heat insulation element according to the invention it is possible that the respective fastening element, for example a plug is pushed through the reinforcement mesh and the non-hardened carrier made of adhesive mortar. Alternatively, it is also possible that the carrier made of adhesive mortar hardens in a first step before the plug is pushed through the reinforcement mesh. In the first alternative it is of course advantageous that the carrier does not have to be perforated before setting the plug, but the plug will be inserted through the non-hardened carrier into a hole that has been previously drilled through the heat insulating board in the façade.

According to another characteristic of the invention it is provided that the reinforcement mesh is essentially placed in the centre of the carrier. In this case it has turned out to be advantageous that the reinforcement mesh is placed with the entire circumference thereof in the carrier, such that the traction forces will be received by the reinforcement mesh and the carrier. Hereby, a damage of the reinforcement mesh caused by the rough building site conditions will also be avoided.

Advantageously, the reinforcement mesh is square and in particular comprises an edge length comprised between 100 mm and 300 mm, in particular between 200 mm and 300 mm. On the one hand, these dimensions are sufficient for receiving the required traction forces. On the other hand, these dimensions of the reinforcement mesh are sufficient for enabling a plug head of the fastening element to be adjacent to the reinforcement mesh in a plane manner. However, in an alternative embodiment of the invention it is also provided that the reinforcement mesh is applied in a strip-like form as to cover joints of adjacent insulation boards. Such usual reinforcement meshes, e.g. glass fibre mesh, metal lath or plastic mesh, present a mesh size comprised between 3 and 8 mm, preferably between 5 and 6 mm. The meshes are square.

According to another characteristic of the invention it is provided that the reinforcement mesh comprises a preferably centrically arranged aperture for receiving a plug having a plug shank and a plug head, wherein the aperture has a size which is larger than the diameter of the plug shank and smaller than the diameter of the plug head. The aperture arranged in the reinforcement mesh which serves for receiving the plug shank has the advantage that during tightening the plug, in which this one is twisted with respect to the abutment, the reinforcement mesh will not be wrenched from its anchorage. Individual parts of the reinforcement mesh will not be damaged either hereby.

Finally it is provided for a heat insulation element according to the invention that the abutment, in particular the carrier comprises a material thickness of maximum 5 mm, in particular comprised between 2 and 4 mm. This material thickness can be covered without any problems by the usual rendering systems.

The solution of the above mentioned problem provides for a heat insulation composite system according to the invention that the heat insulation elements comprise abutments having a reinforcement mesh that can be penetrated by plugs in the area of a large surface opposite the building façade, that the reinforcement mesh is placed at a distance from the large surface of the heat insulation element and that the reinforcement mesh comprises an area which is smaller than the area of the large surface of the heat insulation element. Concerning the advantages obtained by such a heat insulation composite system, it is made reference to the advantages of the individual heat insulation elements of the above mentioned embodiments.

Finally, the solution of the above mentioned problem provides with respect to the method according to the invention that a heat insulation composite system according to the above mentioned characteristics is produced in that a carrier made of an adhesive mortar will be applied as component of an abutment onto a large surface of a plate-shaped heat insulation element, a reinforcement mesh will be embedded as further component of the abutment in the carrier, the heat insulation element will be fixed to the building façade by means of at least one plug such that the large surface comprising the abutment is arranged opposite the building façade and the plug will be set through the reinforcement mesh and the non-hardened carrier and that finally a rendering system will be applied onto the surface of the heat insulation element comprising the abutment, wherein the rendering system will be formed with at least one reinforcing reinforcement mesh covering over the heat insulation element.

Alternatively it is provided that instead of a non-hardened carrier a hardened carrier is provided such that the plug will be set through the reinforcement mesh and the hardened carrier.

The above described methods will be improved in that the abutments are mounted on the heat insulation element in the factory.

Other characteristics and advantages of the heat insulation element according to the invention, the heat insulation composite system according to the invention and the method according to the invention will become apparent from the following description of the associated drawing, in which preferred embodiments of the invention are represented. In the drawing.

Figures 1, 2:
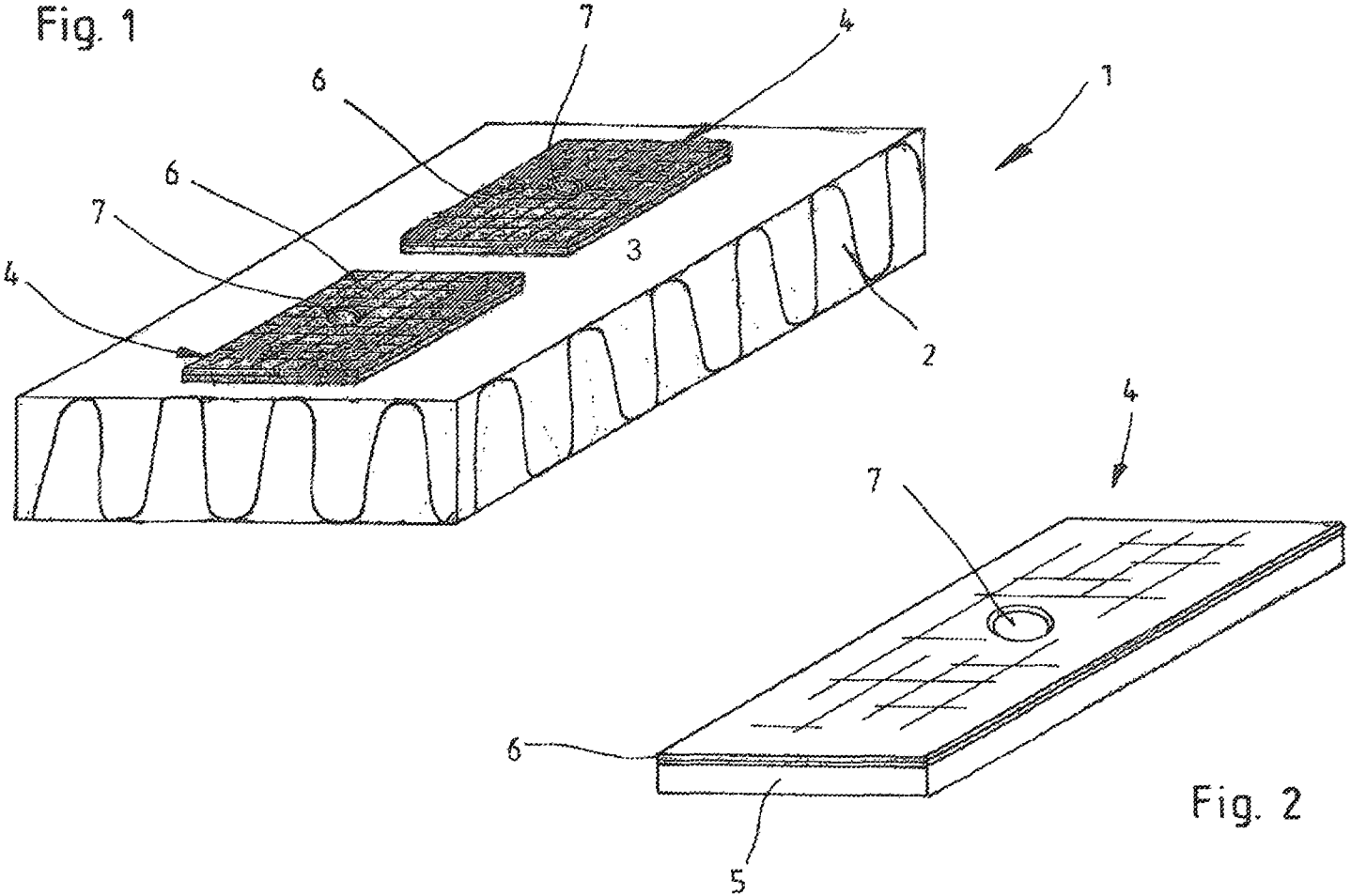
FIG. 1 shows a perspective view of a heat insulation element.
FIG. 2 shows a perspective view of a first embodiment of an abutment.

FIG. 1 shows a heat insulation element 1 for insulating building facades by means of a heat insulation composite system. The heat insulation element 1 is composed of a heat insulating board 2 made of mineral fibers, namely rock wool fibres, bound by binders. Alternatively, the heat insulating board 2 can also be made of glass fibers or slag fibers, wherein the fibers are respectively bound by means of binders. The heat insulating board 2 comprises a large surface 3. The main fiber orientation of the heat insulating board 2 can be parallel or perpendicular with respect to the large surface 3. Two abutments 4 are placed on the large surface 3, the embodiment of the abutments being represented in detail in FIGS. 2 and 3 and still being described in the following.

Each abutment 4 is composed of a carrier 5 and a reinforcement mesh 6 arranged thereon. The carrier 5 is made of adhesive mortar and glued to the surface 3 of the heat insulating board 2. The reinforcement mesh 6 is placed in the carrier 5 at a distance from the surface 3 of the heat insulating board 2 and consists of a glass fibre mesh which is square and comprises an edge length of 250 mm. The reinforcement mesh 6 comprises meshes having a mesh size of 5 mm. Furthermore, the reinforcement mesh 6 comprises a centrically located aperture 7 which serves for the penetration of a fastening element 8 formed as plug (FIG. 5).

In the embodiment according to FIG. 2 the reinforcement mesh 6 is arranged beneath the large surface of the carrier 5, i.e. it is embedded in the carrier 5, wherein this large surface is arranged opposite the large surface 3 of the heat insulating board 2.

Figure 5:
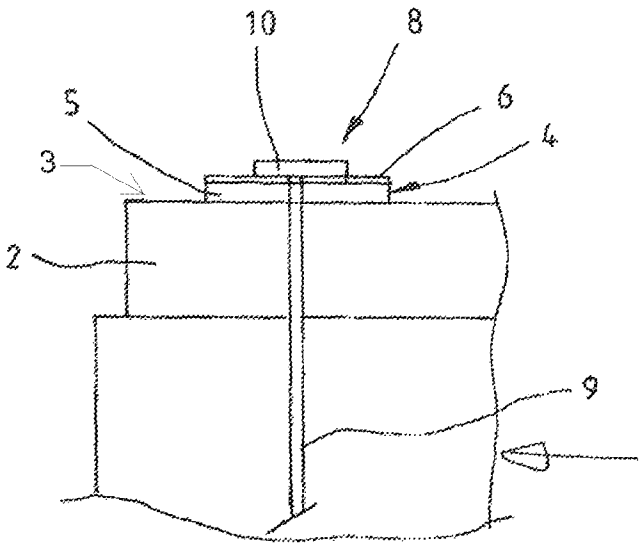
FIG. 5 shows a cut side view of a heat insulation element fixed at a building and FIG. 6 shows another embodiment of an arrangement of heat insulation elements and fastening elements.

According to FIG. 5, the already above mentioned fastening element 8 is composed of a plug shank 9 and a plug head 10. The plug head 10 has a diameter which is larger than the diameter of the aperture 7, whereas the plug shank 9 has a diameter which is smaller than the diameter of the aperture 7.

Figure 4:
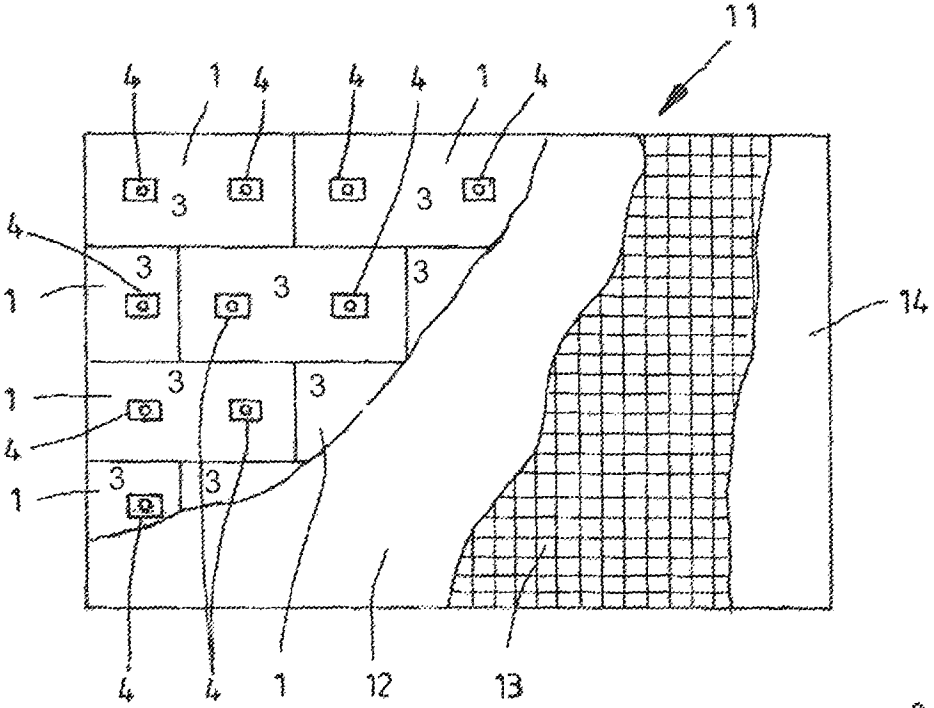
FIG. 4 shows a view of a cutout of a heat insulation composite system.

The abutment represented in FIG. 4 comprises a material thickness of 3 min, wherein the major part of the material thickness refers to the carrier 5.

Figure 3:
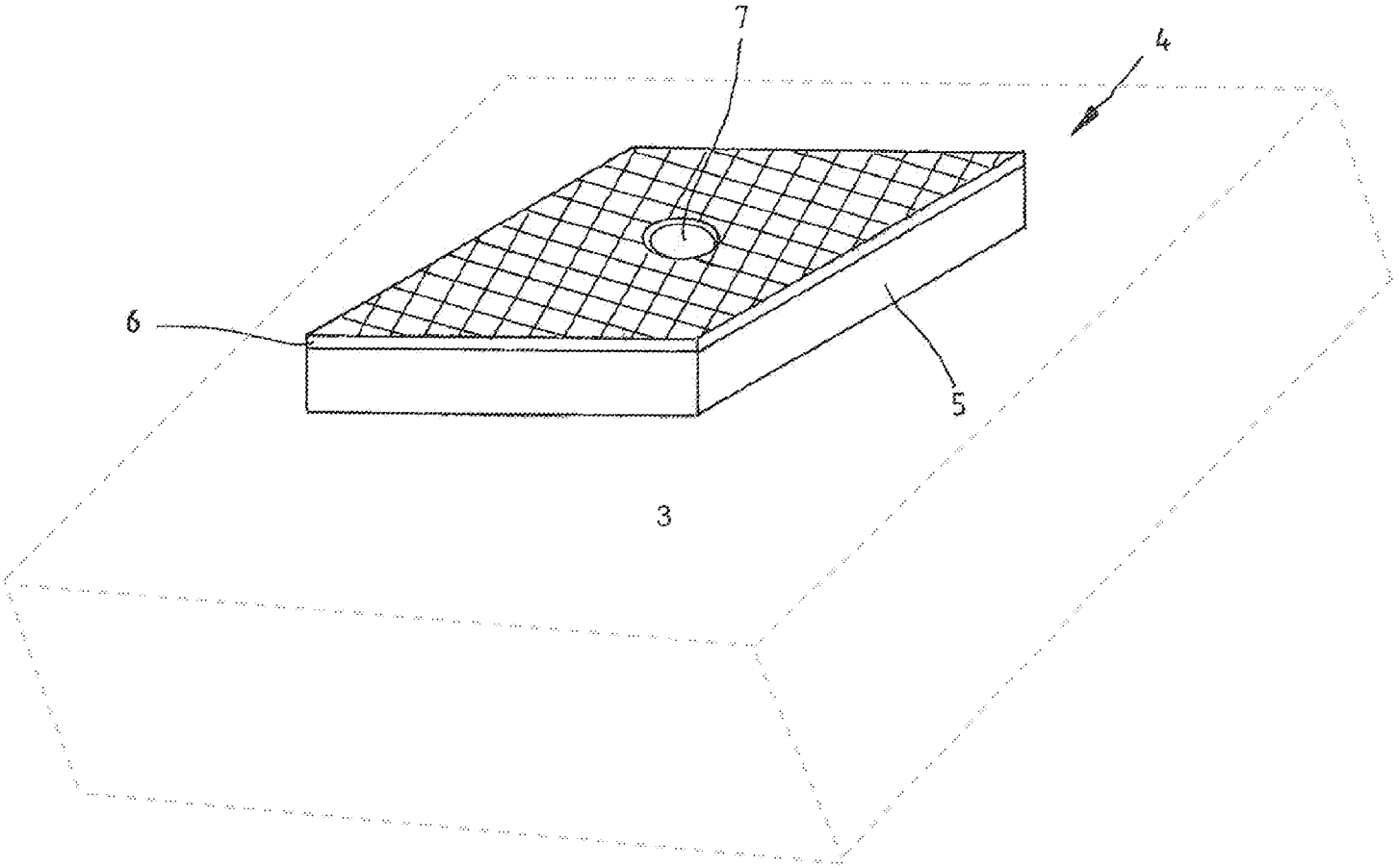
FIG. 3 shows a perspective view of a second embodiment of an abutment.

FIG. 3 shows another embodiment of an abutment 4 which differs from the embodiment according to FIG. 2 in that the reinforcement mesh 6 is not embedded in the carrier 5, but is arranged on the large surface thereof and is glued to this one. Corresponding abutments 4 according to FIGS. 2 and 3 can be manufactured as prefabricated elements and be glued to the heat insulating board 2 in the factory. But it is also possible that the abutments 4 are applied to the heat insulating board 2, namely the surface 3 thereof, on the building site.

Herein, a difference can be made between an arrangement of the abutment 4 on the heat insulating board already glued to a no further represented building, wherein if the carrier 5 has not hardened yet, the fastening element 8 will be inserted through the aperture 7 and the heat insulating board 2 into the building and the heat insulation element 1 will be fixed in such a way. Alternatively, the fastening element 8 can be inserted after the carrier 5 of the abutment 4 has hardened.

Finally, FIG. 4 shows a cutout of a heat insulation composite system 11 composed of a plurality of heat insulation elements 1. After fastening the heat insulation elements 1 to a no further represented façade of a building, a base coat 12 with a reinforcement 13 arranged and embedded therein as well as a finishing coat 14 will be applied. The reinforcement 13 is composed of a large-surface reinforcement mesh which covers over several heat insulation elements 1.

Figure 6:
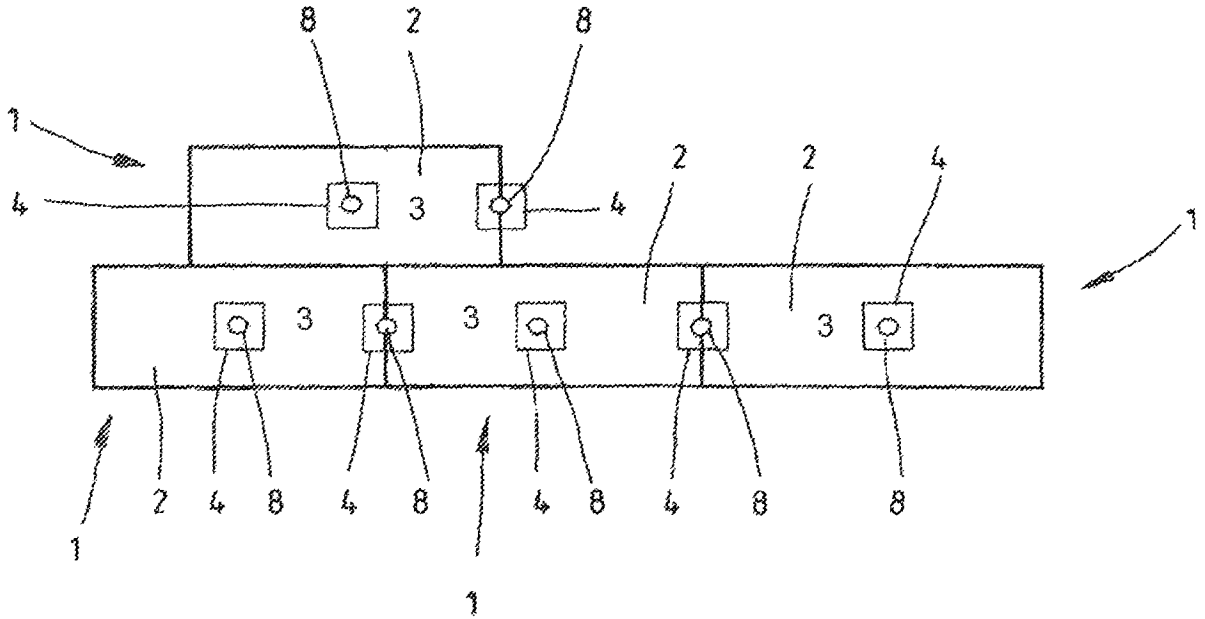

FIG. 6 shows another embodiment of the arrangement of heat insulating boards 2 with fastening elements 8, wherein the heat insulating boards 2 are arranged in a composite system. One can see a first row of three heat insulating boards 2 and a superimposed heat insulating board 2 which indicates a second row. Each heat insulating board 2 has an abutment 4 in the region of the gravity center thereof, which abutment 4 is penetrated by the fastening element 8 such that the heat insulating board, 2 is connected to the no further represented façade by means of only one fastening element 8. In the transition area between two adjacent heat insulating boards 2 of one row another abutment 4 is then provided which is allocated to the adjacent heat insulating boards 2, wherein the fastening element 8 is placed in a region between the adjacent small sides of the heat insulating boards 2.

Altogether, each heat insulating board 2 will be fastened by means of two fastening elements 8 hereby. The abutments 4 and the fastening elements 8 respectively the heat insulating boards 2 are configured corresponding to the above mentioned embodiments.

In a pull-through test it has been found out that a force per fastening element 8 having a plug head 10 with a diameter of 60 mm with a mean value of 0.60 kN can be achieved together with a thermal insulation element 1 according to the invention having a thickness of 80 mm. Using a fastening element 8 having a plug head 10 with a diameter of 90 mm the mean value of this force per fastening element 8 has been increased 0.75 kN. Compared to the prior art these forces per fastening element are nearly doubled as in a pull-through test using well known heat insulation elements a mean value of forces per fastening element of 1.042 kN using a mineral base coat with reinforcement as thick film system up to 1.465 kN using a organic base coat with reinforcement as thin film system was measured. In this test thermal insulation elements made of mineral fibers and having a thickness of 80 mm and fastening elements 8 with plug heads 10 were used having a diameter of 60 mm.

The invention is not limited to the represented exemplary embodiment. Various modifications are possible. Also heat insulating boards made of other heat insulating materials, such as for example EPS, XPS or organic fibers can be for example used.

NUMERAL REFERENCES

1 heat insulation element
2 heat insulating board
3 surface
4 abutment
5 carrier
6 reinforcement mesh
7 aperture
8 fastening element
9 plug shank
10 plug head
11 heat insulation composite system
12 base coat
13 reinforcement
14 finishing coat

The invention claimed is:

1. A heat insulation element for insulating building façades, in particular for heat insulation composite systems, composed of a heat insulating board and a reinforcement mesh that can be penetrated by plugs, wherein the reinforcement mesh is placed in the area of a large surface of the heat insulating board, characterized in that the reinforcement mesh and a carrier are components of an abutment, wherein the reinforcement mesh is spaced apart at a distance from the large surface of the heat insulating board by at least a part of the carrier, and in that the reinforcement mesh comprises a surface area which is smaller than the area of the large surface of the heat insulating board.

2. The heat insulation element according to claim 1, characterized in that the reinforcement mesh is connected to a carrier keeping a distance to the surface of the heat insulating board, wherein the carrier and the reinforcement mesh are components of the abutment.

3. The heat insulation element according to claim 1, characterized in that the heat insulating board is made of mineral fibers bound by means of binders.

4. The heat insulation element according to claim 1, characterized in that the heat insulating board at least comprises one abutment.

5. The heat insulation element according to claim 1, characterized in that one abutment is provided per one square meter of the heat insulating board.

6. The heat insulation element according to claim 2, characterized in that at least one fastening element penetrates the reinforcement mesh and the carrier made of adhesive mortar.

7. The heat insulation element according to claim 2, characterized in that at least one fastening element penetrates the reinforcement mesh and the hardened carrier made of adhesive mortar.

8. The heat insulation element according to claim 1, characterized in that the reinforcement mesh is square and comprises an edge length comprised between 100 mm and 300 mm.

9. The heat insulation element according to claim 1, characterized in that the reinforcement mesh comprises a preferably centrically arranged aperture for receiving a plug having a plug shank and a plug head, wherein the aperture has a size which is larger than the diameter of the plug shank and smaller than the diameter of the plug head.

10. The heat insulation element according to claim 2, characterized in that the thickness of the carrier is a maximum 5 mm.

11. The heat insulation element according to claim 2, characterized in that the thickness of the carrier is between 2 and 4 mm.

12. The heat insulation element according to claim 3, wherein the mineral fibers are rock wool fibers.

13. The heat insulation element according to claim 4, characterized in that the heat insulating board comprises at least two abutments.

14. The heat insulation element according to claim 8, characterized in that the edge length of the reinforcement mesh is between 200 mm and 300 mm.

15. A heat insulation composite system for the heat insulation of a building façade, composed of plate-shaped heat insulation elements, a rendering system and fastening elements which connect the heat insulation elements to the building façade, characterized in that the heat insulation elements comprise abutments having a reinforcement mesh that can be penetrated by fastening elements in the area of a large surface opposite the building façade, that the reinforcement mesh is spaced apart at a distance from the large surface of the heat insulation board by at least a part of a carrier to which the reinforcement mesh is connected and that the reinforcement mesh comprises an area which is smaller than the area of the large surface of the heat insulation element.

16. The heat insulation composite system according to claim 15, prepared by:

applying a carrier made of an adhesive mortar as component of an abutment onto a large surface of a plate-shaped heat insulating board;

embedding a reinforcement mesh as further component of the abutment in the carrier;

fixing the heat insulation element to the building façade by means of at least one plug such that the large surface comprising the abutment is arranged opposite the building façade and the plug will be set through the reinforcement mesh and the non-hardened carrier;

applying a rendering system onto the surface of the heat insulation element comprising the abutment, wherein the rendering system will be formed with at least one reinforcing reinforcement mesh covering over the heat insulation element.

17. The heat insulation composite system according to claim 15, prepared by:

applying a carrier made of an adhesive mortar as component of an abutment onto a large surface of a plate-shaped heat insulating board;

embedding a reinforcement mesh as further component of the abutment in the carrier;

fixing the heat insulation element to the building façade by means of at least one plug such that the large surface comprising the abutment is arranged opposite the building façade and the plug will be set through the reinforcement mesh and the hardened carrier;

applying a rendering system onto the surface of the heat insulation element comprising the abutment, wherein the rendering system will be formed with at least one reinforcing reinforcement mesh covering over the heat insulation element.

18. The heat insulation element according to claim 17, prepared by arranging the abutments on the heat insulating board in a factory.

19. The heat insulation element according to claim 18, prepared by arranging the abutments on the heat insulating board in factory.

* * * * *